US007102577B2

(12) United States Patent
Richard et al.

(10) Patent No.: US 7,102,577 B2
(45) Date of Patent: Sep. 5, 2006

(54) MULTI-ANTENNA HANDHELD WIRELESS COMMUNICATION DEVICE

(75) Inventors: Miguel A. Richard, Sunrise, FL (US); Antonio Faraone, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/955,395

(22) Filed: Sep. 30, 2004

(65) Prior Publication Data

US 2006/0071864 A1 Apr. 6, 2006

(51) Int. Cl.
*H01Q 1/24* (2006.01)

(52) U.S. Cl. ..... 343/702; 343/727; 343/846

(58) Field of Classification Search ..... 343/702, 343/820, 846, 727, 829, 830
See application file for complete search history.

(56) References Cited

U.S. PATENT DOCUMENTS 6,426,723 B1 * 7/2002 Smith et al. ..... 343/700 MS
6,731,920 B1 * 5/2004 Iwai et al. ..... 455/272

FOREIGN PATENT DOCUMENTS

GB 2252453 A * 8/1992

* cited by examiner

*Primary Examiner*—Michael C. Wimer

(57) ABSTRACT

Antenna systems for handheld wireless communication devices (100) that comprise a first unbalanced feed antenna (112, 718, 802, 1204, 1812) and a second balanced feed antenna dipole antenna (202, 716, 804, 1202, 1802) that are located next to a ground structure (116, 810, 1210, 1824) for the handheld wireless communication devices are provided. The balanced feed dipole antenna and the unbalanced feed antenna exhibit disparate spatial-polarization patterns which are suitable for use with a MIMO transceiver, and the decorrelation of signals received by the two antennas is preserved due to a low level of coupling through the ground structure, which is due, in part, to differences in the symmetry properties of current patterns in the ground structure that are associated with the operation of the two antennas. The two antennas can also be used in a transceiver (629) that uses separate antennas to receive and transmit.

22 Claims, 10 Drawing Sheets

DRIVING MONOPOLE

FIG. 12
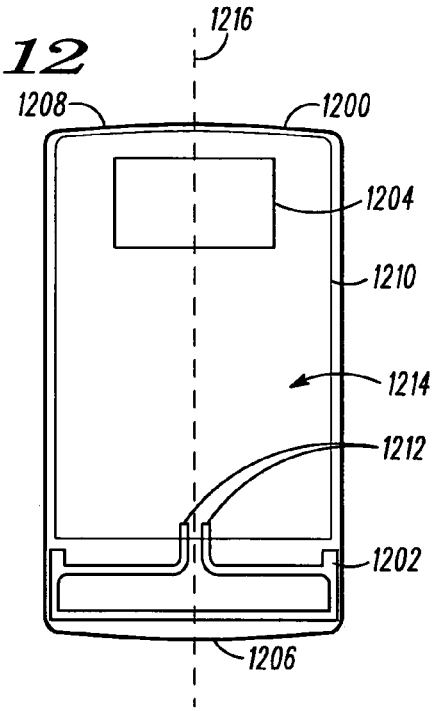
FIG. 14
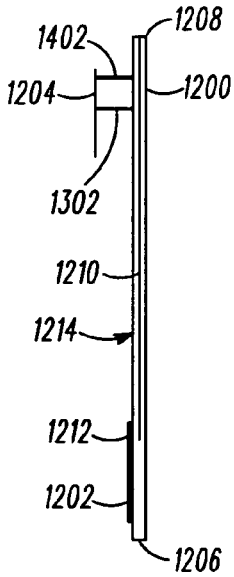
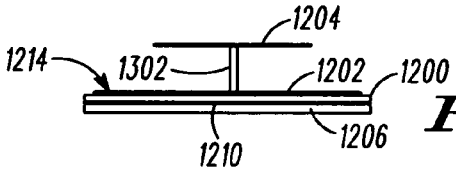
FIG. 13
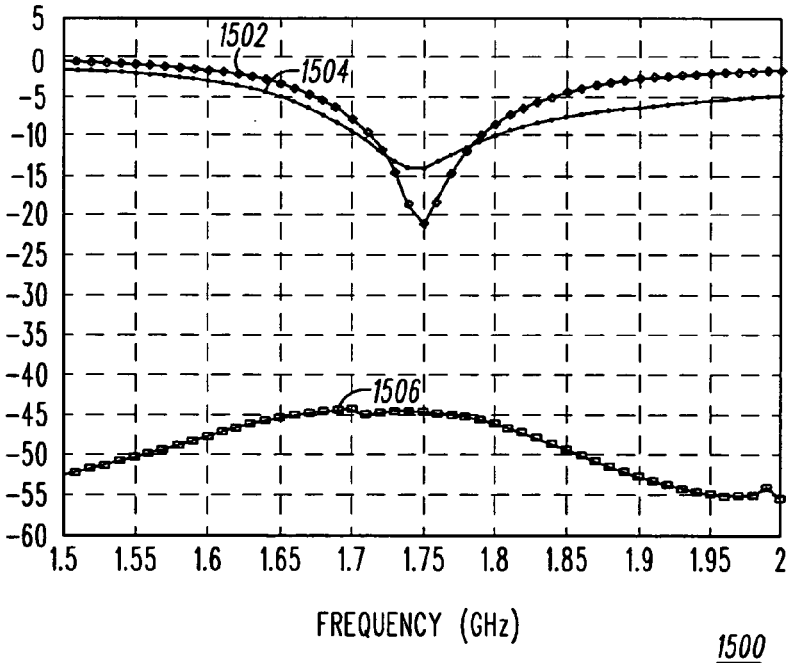
FIG. 15

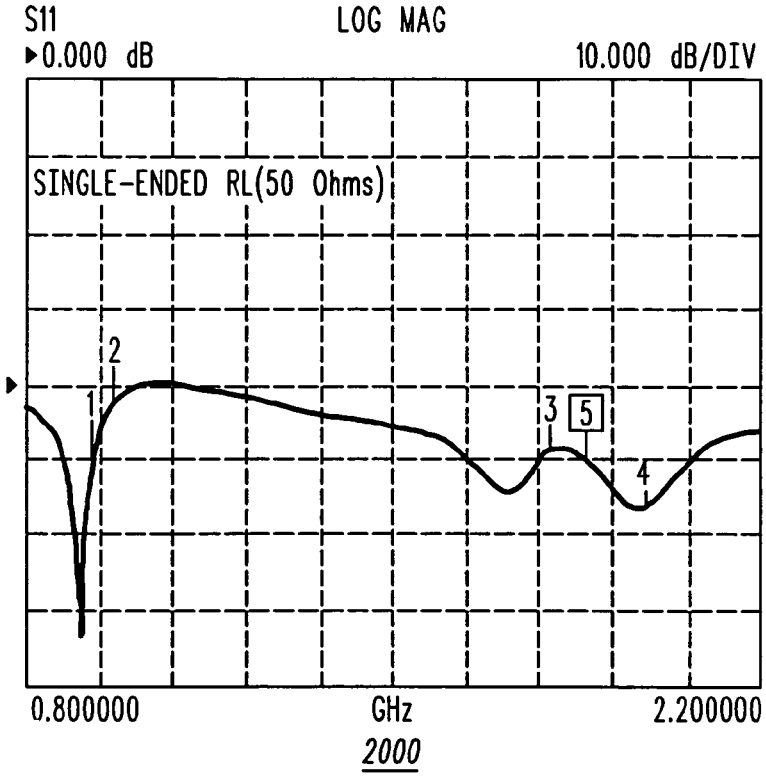
FIG. 20
FIG. 21
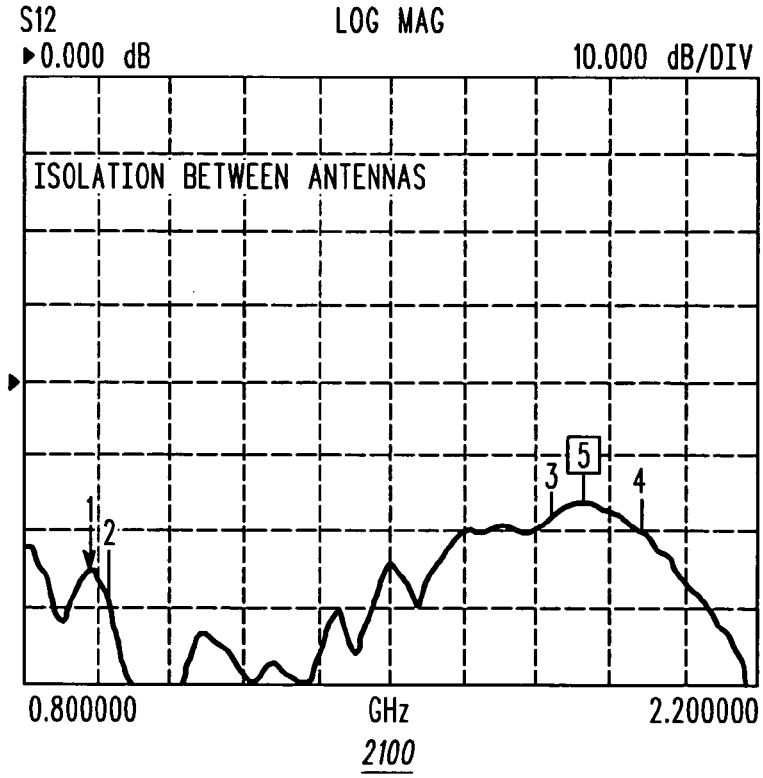

MULTI-ANTENNA HANDHELD WIRELESS COMMUNICATION DEVICE

FIELD OF THE INVENTION

The present invention relates in handheld wireless communication devices.

BACKGROUND OF THE INVENTION

The adaptation of wireless communication devices over the past decade has brought about a sea change in the area of personal communications. Handheld wireless communication devices allow instant and nearly ubiquitous access to telephone networks and the internet.

Looking to the future, there is an interest in enabling handheld wireless communication devices to handle higher bandwidth communication. Among other things, this would facilitate sending and receiving of video, music, and performing other high speed file transfer via handheld wireless communication devices. However, any such plans must work within the bandwidth constraints imposed by government regulations. In order to maximize the effective data bandwidth of a given frequency band, researchers have developed a new class of physical layer communication techniques known as Multi-Input Multi-Output (MIMO). MIMO methods use multiple antennas having different radiation patterns, but operated in the same frequency band to establish, at least partially, independent channels. Thus, using the same frequency band, enhanced bandwidth, or enhanced data reliability can be obtained. The enhancements afforded by MIMO methods depend on the degree of decorrelation between signals transmitted from or received by multiple antennas. In endeavoring to apply MIMO methods to handheld devices one faces limitations imposed by constraints on the practical external design of handheld devices (having multiple antennas protruding in different directions is undesirable), the limited size of handheld devices, and in particular the limited size of the ground structures (e.g., Printed Circuit Board (PCB) ground planes) of handheld devices which serve as ground references or counterpoises for antennas of handheld devices. The foregoing limitations tend to constrain the achievable decorrelation (increase the correlation) between signals associated with multiple antennas, and thereby limit the enhancement that MIMO methods can yield. What is needed is a handheld device design that meets foregoing limitations but can effectively utilize MIMO.

Another goal in designing handheld wireless communication devices, especially for certain market segments, is cost reduction. Handheld wireless devices typically include a transmit/receive switch network which allows a single antenna to be used for both receiving and transmitting signals. At present the high cost of transmit/receive switch networks presents an impediment to further reduction of the costs of handheld wireless communication devices.

BRIEF DESCRIPTION OF THE FIGURES

The present invention will be described by way of exemplary embodiments, but not limitations, illustrated in the accompanying drawings in which like references denote similar elements, and in which:

FIG. 12 is a bottom view of a third circuit board with two antennas according to a fourth embodiment;

FIG. 13 is front view of the third circuit board with two antennas shown in FIG. 12;

FIG. 14 is a side view of the third circuit board with two antennas shown in FIGS. 12–13;

FIG. 15 is a third graph including plots of S parameters that characterize the third circuit board with two antennas shown in FIGS. 12–14;

FIG. 20 is a plot of return loss for a second of the two dual frequency antennas shown in FIG. 18; and FIG. 21 is a plot of the magnitude of coupling between the two dual frequency antennas shown in FIG. 18.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Figure 1:
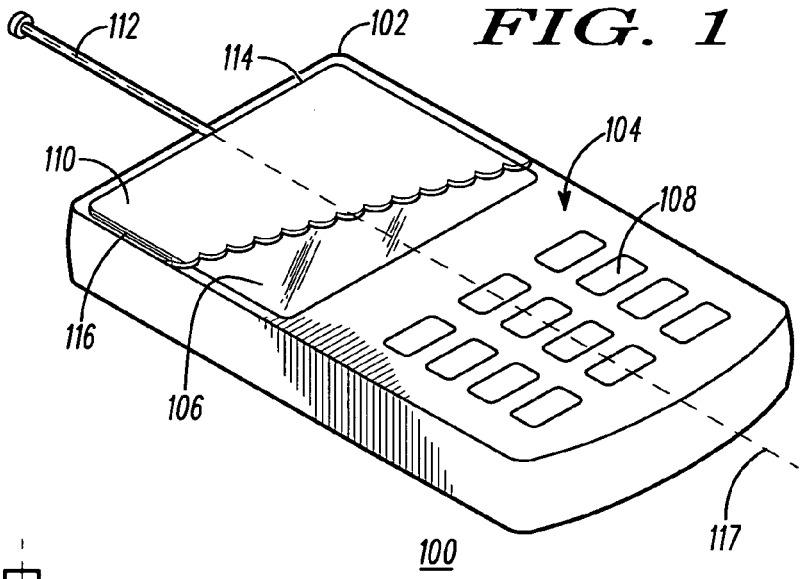
FIG. 1 is a perspective view of a handheld wireless communication device according to a first embodiment.
Figure 2:
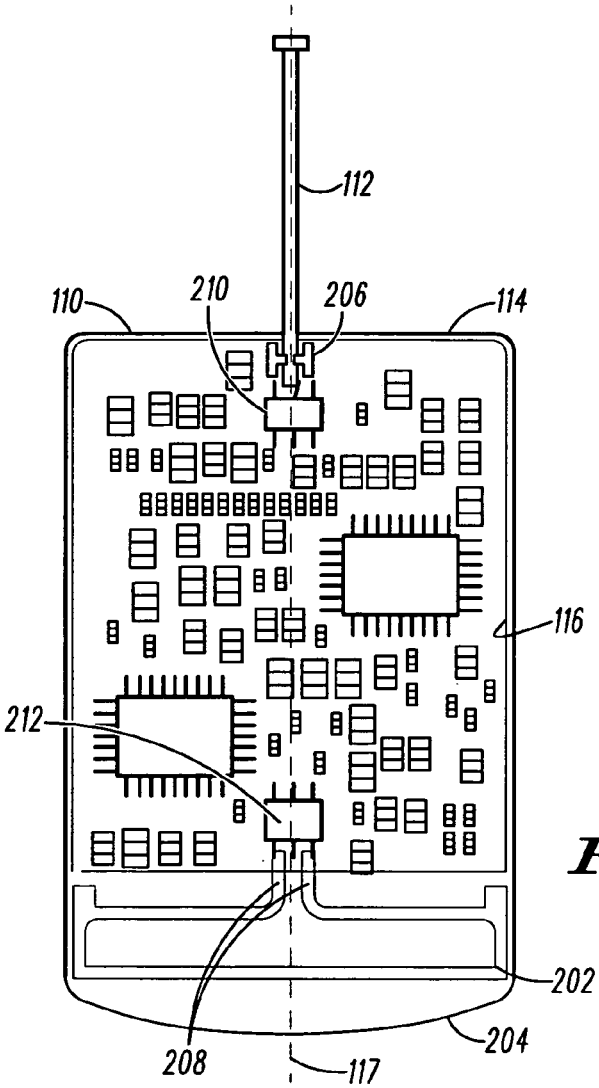
FIG. 2 is a bottom view of a first printed circuit board with two antennas that are part of the handheld wireless communication device shown in FIG. 1.

FIG. 1 is a perspective view of a handheld wireless communication device 100 according to a first embodiment. The device 100 comprises a housing 102 that includes a front surface 104. A display 106 and a keypad 108 are located at the front surface 104 of the housing 102. A populated circuit substrate, in particular a first printed circuit board 110 is located in the housing 102. The first circuit board 110 includes a ground plane 116. A first antenna, which is a monopole antenna 112 extends from the first circuit board 110 out of the housing 102. The monopole antenna 112 is a single ended antenna which is to say that it is driven by applying a signal to a single terminal 206 (FIG. 2). The monopole antenna 112 is an unbalanced feed antenna which is to say that the monopole antenna 112 is driven by applying a signal between the monopole antenna 112 and the ground plane 116. The monopole antenna 112 is mounted near a top end 114 of the first circuit board 110 at a transverse center of the first circuit board 110. The monopole antenna 112 is oriented parallel to a common longitudinal centerline 117 of the device 100 and of the first circuit board 110. The longitudinal centerline 117 is located at the transverse center of the first circuit board 110 and ground plane 116. The ground plane 116 of the first circuit board 110 serves as a counterpoise of the monopole antenna 112. During the operation of the monopole antenna 112 electric field lines extend between the monopole antenna 112 and the ground plane 116. In effect, the ground plane 116 serving as a counterpoise plays a complementary role to that of the monopole antenna 112 in radiating and receiving wireless signals. In use currents are induced in the ground plane 116 as well as the monopole antenna 112 when signals are transmitted or received by the monopole antenna 112.

FIG. 2 is a bottom view of the first circuit board 110 with the monopole antenna 112 and a second antenna, in particular a differentially fed, folded dipole antenna 202. Alternatively, a t-matched dipole antenna is used as the second antenna. The dipole antenna 202 is located on the first circuit board 110 near a bottom end 204 of the first circuit board 110. The dipole antenna 202 is suitably formed by patterning a metal layer of the first circuit board 110. Alternatively, the dipole antenna is manufactured separately from the first circuit board 11. In contrast to the monopole antenna 112, which includes the single feed terminal 206, the dipole antenna 202 is double ended and includes a pair of feed terminals 208. The pair of feed terminals 208 constitute a balanced feed of the dipole antenna 202. The feed terminals 208 are located near the longitudinal centerline 117 on opposite sides of the longitudinal centerline 117. At least a first circuit component 210 (either discrete or integrated) of communications circuits built on the first circuit board 110 is coupled to the single feed terminal 206 of the monopole antenna 112. Also, at least a second circuit component 212 of communications circuits built on the first circuit board 110 is coupled to the pair of feed terminals 208 of the dipole antenna 202. The dipole antenna 202 is arranged on the first circuit board 110 perpendicular to the common longitudinal centerline 117 of the device 100 and the first circuit board 110. Alternatively, the dipole antenna 202 extends away (e.g. perpendicularly) from the first circuit board 110. Particularly in the latter case, the dipole antenna 202 is, alternatively, non-planar. For example, the dipole antenna 202 can have a compound curve shape that conforms to the shape of a housing of a wireless communication device. As shown, the dipole antenna 202 is also perpendicular to the monopole antenna 112. The latter arrangement makes the polarization associated with the monopole antenna 112 generally perpendicular to the polarization associated with the dipole antenna 202 and also orients the gain patterns of the antennas 112, 202 differently. The differences between the orientation of the gain patterns and polarizations associated with the two antennas 112, 202, viewed in isolation, would tend to lead to the conclusion that when operated in an environment where signals are scattered and multipath effects occur (e.g., in an urban setting or indoors), signals reaching the two antennas would be, statistically speaking, less correlated—a condition which is desirable for MIMO systems. However viewing the polarizations and gain patterns of each of two antennas in isolation does not take into account the fact that operating two antennas in close proximity and sharing the same ground structure generally leads to intercoupling between the two antennas and perforce to undesirable increases in the degree of correlation between signals. However, as will be described below the design of the device 100 affords relatively low internal intercoupling between the monopole antenna 112 and the dipole antenna 202, such that the decorrelation of signals coupled from wireless channels through the two antennas 112, 120 is preserved.

The structure of the dipole antenna 202 exhibits bilateral symmetry about the longitudinal centerline 117 of the first circuit board 110, however when the dipole antenna 202 is driven, currents established in the dipole antenna 202 and the ground plane 116 are antisymmetric (odd) about the longitudinal centerline 117 of the first circuit board 110.

Although the ground plane 116 is typically located within the first circuit board 110, the ground plane 116 is shown in FIG. 2, as though in an x-ray, to show its relation to the dipole antenna 202. Note that the ground plane 116 does not extend underneath most of the dipole antenna 202. Only the pair of feed terminals 208 of the dipole antenna 202 extend over the ground plane 116 forming short striplines that are used to couple signals into and out of the dipole antenna 202.

Figure 3:
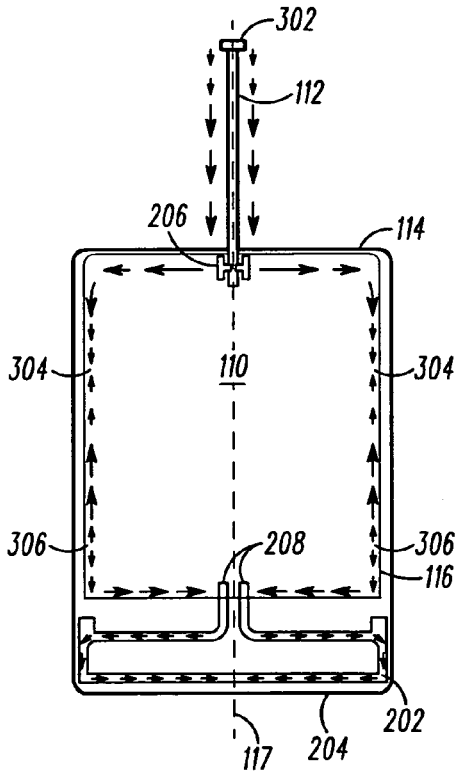
FIG. 3 illustrates a first current pattern that is induced in the first printed circuit board and two antennas shown in FIGS. 1–2 when driving a first of the two antennas.

FIG. 3 illustrates a first current pattern that is induced in the first circuit board 110 and two antennas 112, 202 shown in FIGS. 1–2 when driving the monopole antenna 112. The first current pattern, and other current patterns described below correspond to an instant in time during a periodic microwave or RF cycle. In FIG. 3, and in FIGS. 4, 9 and 10 discussed below, arrows located around the depicted circuit boards and antennas roughly indicated the local direction and magnitude of the current. As shown in FIGS. 3 4, 9 and 10 currents are concentrated near the periphery of the depicted circuit boards.

In the first current pattern shown in FIG. 3 there is a current null at a top end 302 of the monopole antenna 112 that is remote from the first circuit board 110, and two pairs of nulls 304, 306 along the length of the ground plane 116. The direction of current flow reverses at the nulls 304, 306. Furthermore, as shown, current is induced in the dipole antenna 202, when driving the monopole antenna 112. However, the current induced in the ground plane 116, and in the dipole antenna 202 by operating the monopole antenna 112 is symmetric about the longitudinal centerline 117 of the first circuit board 110. Because the dipole antenna 202 is meant to operate in a mode that is antisymmetric, and is coupled to one or more communication circuit components (e.g. differential amplifiers) designed to couple balanced signals to and from the dipole antenna 202, the symmetric current induced on the dipole antenna 202 by operating the monopole antenna 112 will be rejected by communication circuits coupled to the to the dipole antenna 202. Thus, even though operating the monopole antenna 112 does induce currents in the dipole antenna 202, because of the mismatch between the symmetry of the currents induced by the monopole antenna 112 and the antisymmetry of currents associated with the intended mode of the dipole antenna 202, the effective amount of undesirable coupling of signals from the monopole antenna 112, through the ground plane 116 to the dipole antenna 202 and communication circuits (e.g., balanced amplifiers) coupled to the dipole antenna 202 is limited.

Figure 4:
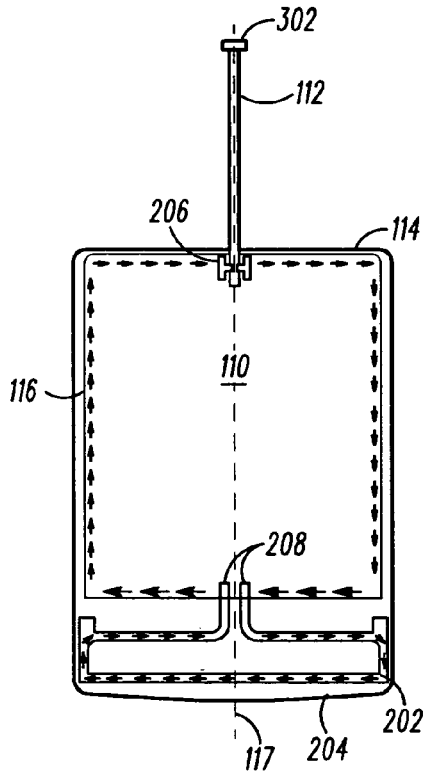
FIG. 4 illustrates a second current pattern that is induced in the first circuit board and two antennas when driving a second of the two antennas.

FIG. 4 illustrates a second current pattern that is induced in the first circuit board 110 when driving the dipole antenna 202. Electromagnetic coupling of the dipole antenna 202 and the ground plane 116 establishes the second current pattern including currents in the ground plane 116. The second current pattern is antisymmetric about the longitudinal centerline 117 of the first circuit board 110. The second current pattern includes a current which circles the ground plane 116, but does not, to any significant extent, pass onto the monopole antenna 112. Even if some small current were to be induced in the monopole antenna 112 such a current would tend to flow in opposite directions on opposite sides of the monopole antenna 112 such that the net current through the single feed terminal 206 of the monopole antenna 112 would be negligible. Thus notwithstanding that the monopole antenna 112 is coupled to the ground plane 116, and currents are induced in the ground plane 116 when the dipole antenna 202 is driven, the coupling of signals from the dipole antenna 202 through the ground plane 116 to the monopole antenna 112 is limited in the device 100. Thus, the two antennas 112, 202 of the device 100 can be used independently for different purposes or to obtain decorrelated signals for MIMO communication.

Figure 5:
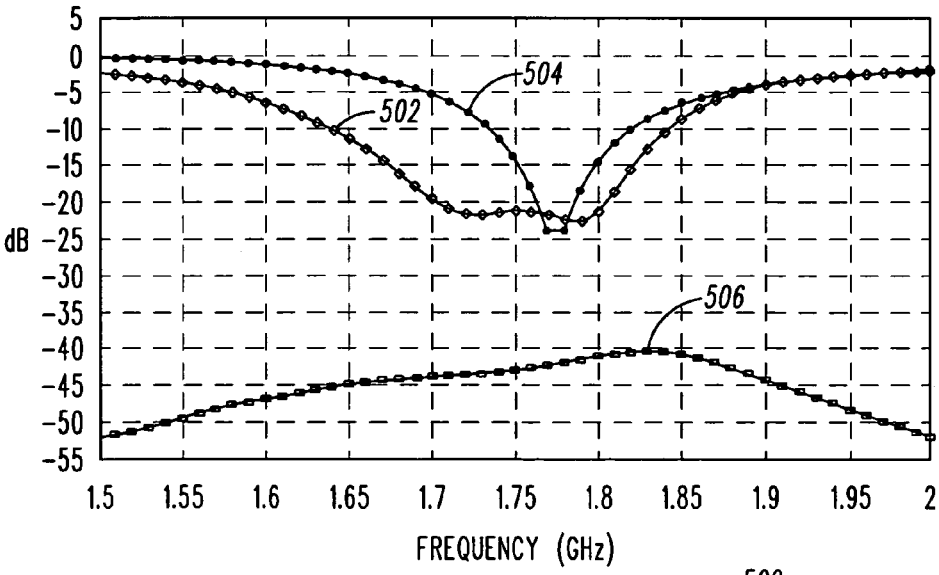
FIG. 5 is a first graph including plots of S parameters that characterize the first printed circuit board with two antennas shown in FIG. 3.

FIG. 5 is first graph 500 including plots 502, 504, 506 of S parameters that characterize the first circuit board 110 with two antennas 112, 202 shown in FIG. 3. In FIG. 5 the abscissa indicates frequency and is marked off in gigahertz, and the ordinate indicates the magnitude of S parameters and is marked off in decibels. The first plot 502 is the return loss of the monopole antenna 112 and the second plot 504 is the return loss of the dipole antenna 202. The two antennas 112, 202 have overlapping pass bands. The current patterns shown in FIGS. 3–4 are for operation at a frequency in the pass bands. The third plot 506 is the magnitude of coupling between the monopole antenna 112 and the dipole antenna 202. The coupling between the two antennas 112, 202 is less than −40 dB over the domain of the graph which encompasses the overlapping pass bands of the two antennas 112, 140. The third plot 506 shows a high level of isolation which is consistent with the explanations of isolation given above with reference to FIGS. 3–4. Although particular theories of operation have been presented above, the inventors do not wish to be bound by these theories.

Although the device 100 is a non-folding 'candy bar' form factor cellular telephone. Alternatively, the device 100 includes two parts that are moveable with respect to each other from a closed configuration to an open configuration. A suitable example of a two part device is a clamshell cellular telephone.

Figure 6:
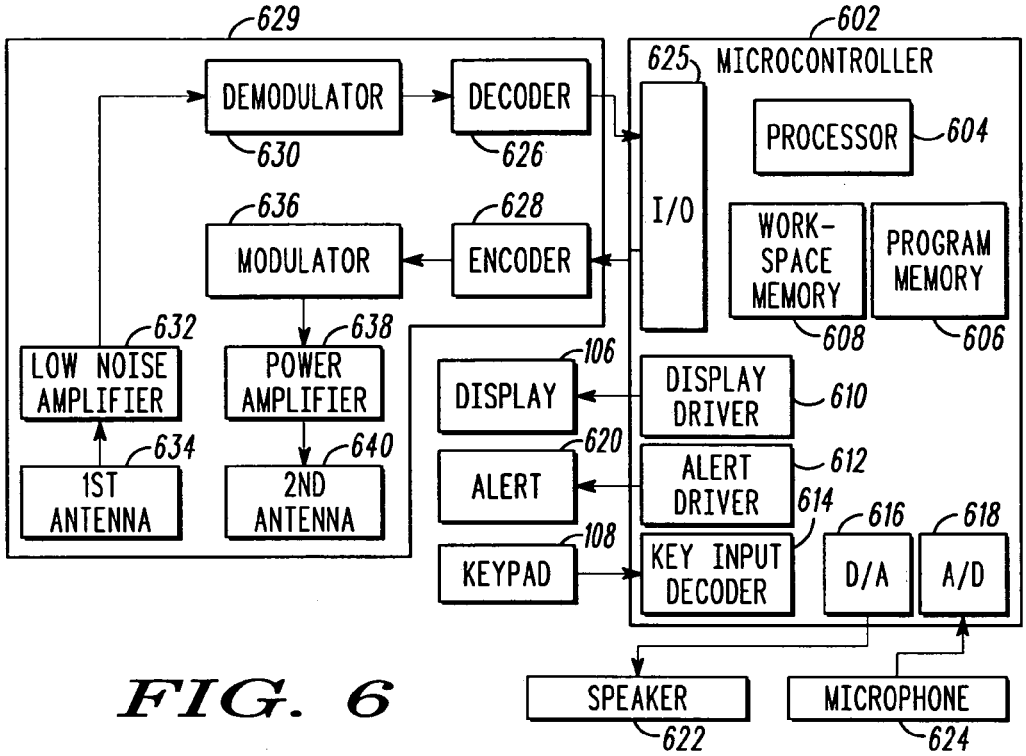
FIG. 6 is a block diagram of the handheld wireless communication device shown in FIG. 1 according to the first embodiment.

FIG. 6 is a block diagram of the handheld wireless communication device 100 shown in FIG. 1 according to the first embodiment. According to the first embodiment as shown in FIG. 6, the device 100 comprises a microcontroller 602, that includes a processor 604, a program memory 606, a workspace memory 608, a display driver 610, an alert driver 612, a key input decoder 614, a digital-to-analog converter (D/A) 616, and an analog-to-digital converter (A/D) 618. The processor 604 uses the workspace memory 608 to execute programs for operating the device 100 that are stored in the program memory 606. The display driver 610 is coupled to the display 106. The alert driver 612 is coupled to an alert 620 such as an audible alert or a vibrating alert. The key input decoder 614 is coupled to the keypad 108. The D/A 616 is coupled to a speaker 622, and the A/D 618 is coupled to a microphone 624. Audio amplifiers (not shown) can be provided for the speaker 62 and the microphone 624.

The microcontroller 602 also comprises an input/output interface (I/O) 624 that is coupled to a decoder 626 and an encoder 628 of a transceiver 629. The decoder 626 and the encoder 628 handle channel decoding and encoding and optionally include an additional internal stages that handle source decoding and encoding, although the latter might also be handled by the processor 606 or other dedicated decoders and encoders (not shown). The decoder 626 is coupled to and receives signals from a demodulator 630. The demodulator 630 receives a microwave or RF communication signal processes it to extract a base band signal and outputs the base band signal to the decoder 626. The demodulator 630 can comprises multiple internal stages that shift the frequency of the received signal in stages. Each stage can comprise a mixer, filter, and amplifier (not shown). A low noise amplifier 632 is coupled to the demodulator 630 and to a first antenna 634. The first antenna 634 is either one of the monopole antenna 112 and the dipole antenna 202. If the first antenna 634 is the dipole antenna 202, then the low noise amplifier 634 is a differential amplifier having differential inputs coupled to the pair of terminals 208 of the dipole antenna 202. The low noise amplifier 632 receives signals from the first antenna 634, amplifiers the signals and outputs amplified versions of the signals to the demodulator 630.

The encoder 628 is coupled to a modulator 636. The encoder 628 outputs encoded base band signals to the modulator 636. The modulator 636 is coupled through a power amplifier 638 to a second antenna 640. The second antenna is either one of the monopole antenna 112 and the dipole antenna 202 which is not used as the first antenna 634. If the second antenna 640 is the dipole antenna 202, then the power amplifier 638 is differential amplifier having differential outputs coupled to the pair of terminals 208 of the dipole antenna 202. The modulator 636 modulates a carrier with the base band signals received from the encoder 628 and outputs a modulated RF or microwave signal which is amplified by the power amplifier 638 and radiated by the second antenna 640.

The architecture of the transceiver 629 shown in FIG. 6 does not require the use of a transmit/receive switch network and is able to support full duplex communications without the use of a hybrid.

Antennas included in a third, a fourth, and a fifth embodiment described below are alternatively used as the first antenna 634 and the second antenna 640.

Figure 7:
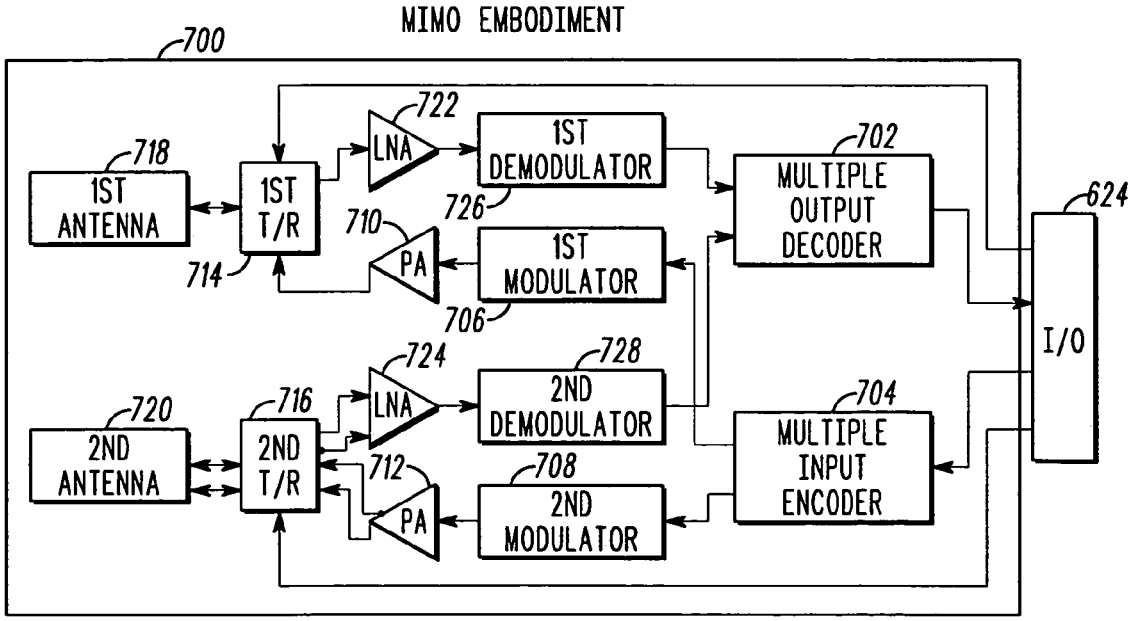
FIG. 7 is a partial block diagram of the handheld wireless communication device shown in FIG. 1 according to a second embodiment.

FIG. 7 is a partial block diagram of the handheld wireless communication device 100 shown in FIG. 1 according to a second embodiment. FIG. 7 shows an alternative transceiver 700 architecture for the device 100. The alternative transceiver 700 comprises a multiple output decoder 702 and a multiple input encoder 704 coupled to I/O 624. The multiple output decoder 702 and the multiple input encoder 704 use MIMO processing to enhance the spectral efficiency of communications conducted with the device 100. Although the internal details of MIMO processing are outside the focus of the present description, it is important to note in the present context that MIMO processing calls for the use of multiple antennas capable of transmitting and receiving decorrelated signals such as provided in a practical compact form in the device 100 as described above with reference to FIGS. 1–5. Note that the word "output" in "multiple output decoder" 702 refers to outputs of a wireless channel, and the term "input" in "multiple input encoder" 704 refers to inputs of the wireless channel. The multiple input encoder 704 is coupled to a first modulator 706 and a second modulator 708. The first modulator 706 and the second modulator 708 are coupled through a first power amplifier 710 and a second power amplifier 712 respectively to a first transmit/receive switch (T/R) 714 and a second transmit/receive switch (T/R) 716 respectively. The first T/R 714 is coupled to a first antenna 718, and the second T/R 716 is coupled to a second antenna 720. The first T/R 714 and the second T/R 716 are also coupled through a first low noise amplifier 722 and a second low noise amplifier 724 respectively to a first demodulator 726 and a second demodulator 728 respectively. The first demodulator 726 and the second demodulator 728 are coupled to the multiple output decoder 702. The second antenna 720 is the dipole antenna 202 or one of the dipole antennas described in other embodiments hereinbelow. Accordingly, the second power amplifier 712 has differential outputs, and the second low noise amplifier 724 has differential inputs. The multiple output decoder 702 and the multiple input encoder 704 are alternatively realized in hardware, i.e. in specialized circuits, in software, or in a combination thereof. Although, one particular MIMO transceiver architecture has been shown in FIG. 7, the invention should not be construed as limited to the particular depicted architecture. Rather, the two antenna systems disclosed herein can be used in conjunction with various types of MIMO processing systems.

Figure 8:
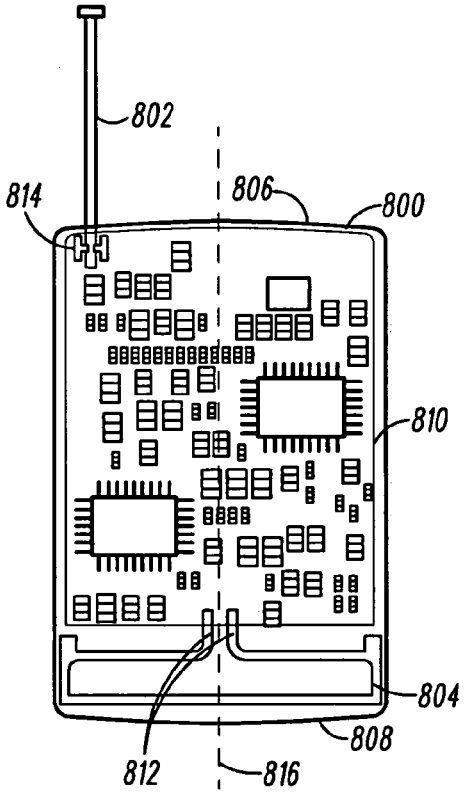
FIG. 8 is a bottom view of a second circuit board with two antennas according to a third embodiment.

FIG. 8 is a bottom view of a second circuit board 800 with a monopole antenna 802, and a folded dipole antenna 804 for use in the device 100 according to a third embodiment. In the third embodiment, the monopole antenna 802 is attached closer to one side of a top edge 806 of the second circuit board 800 (as opposed to being aligned on a longitudinal centerline 816 of the second circuit board 800). The dipole antenna 804 is located near a lower edge 808 of the second circuit board 800 as in the first embodiment. A ground plane 810 of the second circuit board 800 does not extend under most of the dipole antenna 804. The dipole antenna 804 comprises a pair of terminal 812, and the monopole antenna 802 comprises a single terminal 814 all of which are disposed proximate the periphery of the ground plane 810.

Figure 10:
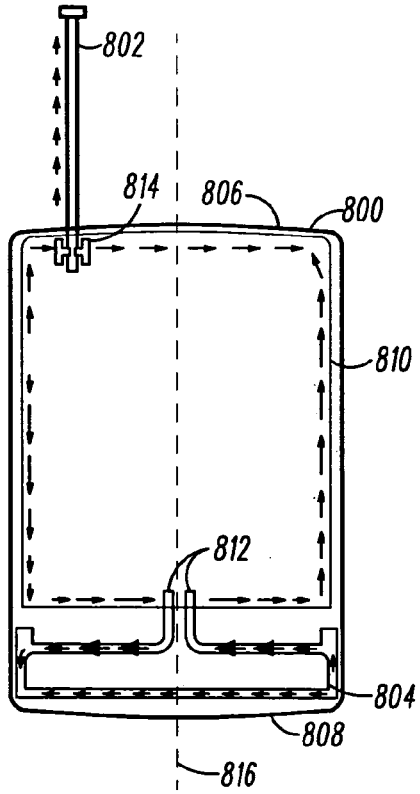
FIG. 10 illustrates a second current that is induced in the second circuit board and two antennas shown in FIG. 8 when driving a second of the two antennas shown in FIG. 8.
Figure 9:
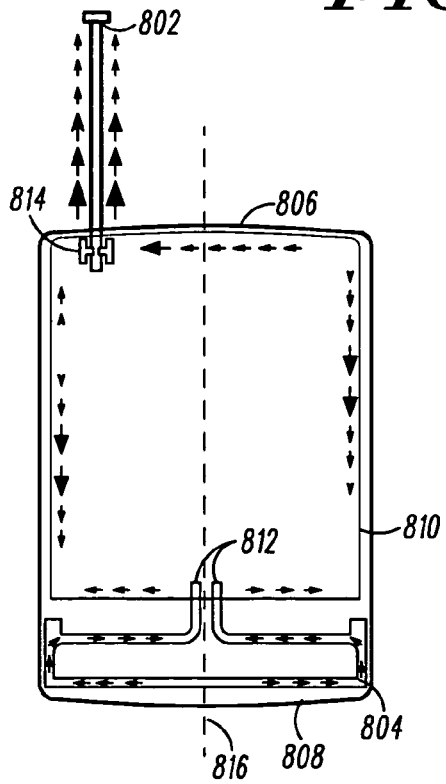
FIG. 9 illustrates a first current pattern that is induced in the second circuit board and two antennas shown in FIG. 8 when driving a first of the two antennas shown in FIG. 8.

FIG. 9 illustrates a first current pattern that is induced in the second circuit board 800, the monopole antenna 802 and the dipole antenna 804 when driving the monopole antenna 802. FIG. 10 illustrates a second current that is induced in the second circuit board 800, the monopole antenna 802 and the dipole antenna 804 when driving the dipole antenna 804. Note that driving the monopole antenna 802 induces current oscillation in the dipole antenna 804. However, the current induced in the dipole antenna 804 is approximately symmetric and therefore most of the signal induced at the pair of terminals 812 of the dipole antenna 804 by driving the monopole antenna 802 is easily rejected by differential circuits (e.g., one or more differential amplifiers) coupled to the pair of terminals 812. Note that driving the dipole antenna 804 induces a relatively small current in the monopole antenna 802. Note also that the current patterns induced in the ground plane 810 when driving either of antennas 802, 804 are asymmetric (neither symmetric nor antisymmetric) about the longitudinal center line 816 of the second circuit board 800.

Figure 11:
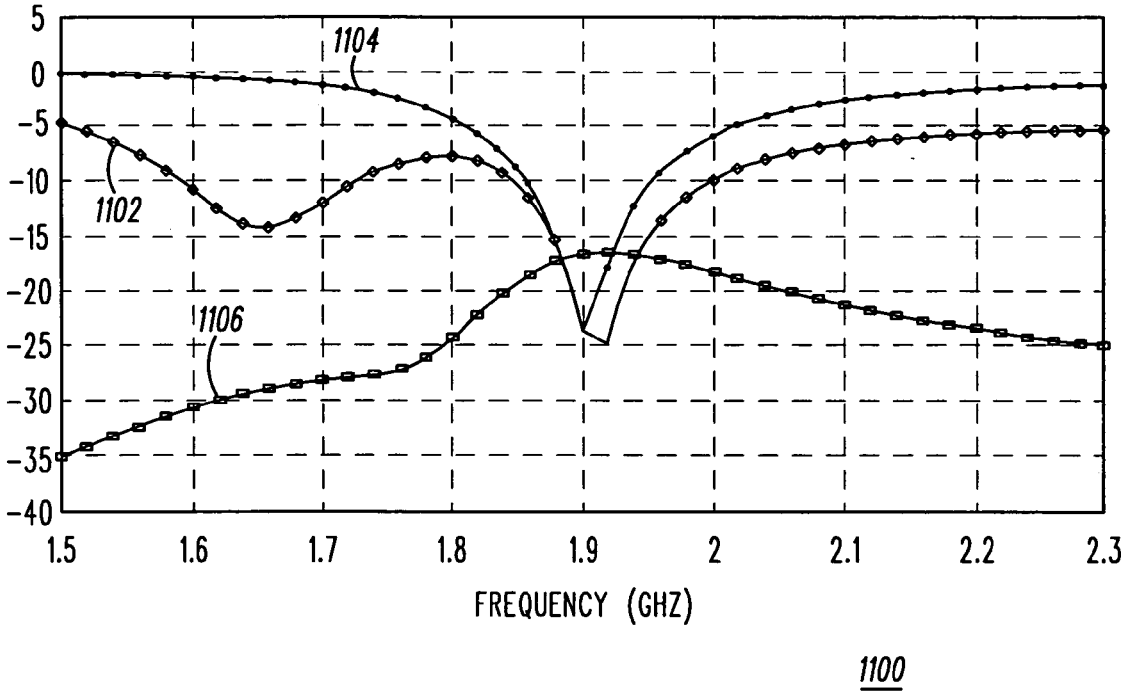
FIG. 11 is a second graph including plots of S parameters that characterize the second circuit board with two antennas shown in FIG. 8.

FIG. 11 is a second graph 1100 including plots of S parameters that characterize the second circuit board 800 with the monopole antenna 802 and the dipole antenna 804 shown in FIG. 8. The abscissa of the second graph 1100 indicates frequency and is marked off in gigahertz and the ordinate indicates the magnitude of various S-parameters and is marked off in decibels. In the second graph 1100 a first plot 1102 is the return loss of the monopole antenna 802, a second plot 1104 is the return loss of the dipole antenna 804 and a third plot 1106 is the coupling between the monopole antenna 802 and the dipole antenna 804. As shown in the second graph 1100 the two antennas 802, 804 exhibit overlapping pass bands. The current patterns shown in FIGS. 9–10 are for operation at a frequency near the center of the pass bands. As reflected in the third plot 1106 the magnitude of coupling between the two antennas 802, 804 is less than about −16 dB over the frequency range of the pass bands. Note that the isolation between the two antennas 802, 804 in the third embodiment is not as good as the isolation between the two antennas 112, 202 in the first embodiment. This is due to the fact that decentering the monopole antenna 802 introduces the aforementioned asymmetries in the current patterns in the ground plane 810, such that the asymmetric current pattern in the ground plane 810 associated with the operation of the dipole antenna 804 is somewhat more correlated with the asymmetric current pattern in the ground plane 810 that is associated with the operation of the monopole antenna 802 compared to the extremely low (in theory zero) correlation of the symmetric and antisymmetric current patterns associated with the operation of the monopole antenna 112 and the dipole antenna 202 in the first embodiment. Nonetheless, the degree of isolation achieved in the third embodiment is sufficient for certain applications.

FIG. 12 is a bottom view of a third circuit board 1200 with two antennas 1202, 1204 for use in the device 100 according to a fourth embodiment, FIG. 13 is front view of the third circuit board 1200 with the two antennas 1202, 1204 and FIG. 14 is a side view of the third circuit board 1202 with the two antennas 1202, 1204. The two antennas 1202, 1204 include a dipole antenna 1202 located near a lower end 1206 of the third circuit board 1200, and a planar inverted "F" antenna (PIFA) 1204 located near an upper end 1208 of the third circuit board 1200. The third circuit board 1200 includes a ground plane 1210 that does not extend under most of the dipole antenna 1202. Only a pair of signal feeds 1212 of the dipole antenna 1202 overlap the ground plane 1210 forming strip line terminals. The PIFA 1204 is displaced from a bottom surface 1214 of the third circuit board 1200. A signal feed 1302 and a grounding conductor 1402 extend from the bottom surface 1214 of the third circuit board 1200 to the PIFA 1204. The signal feed 1302 is an unbalanced feed of the PIFA 1204. A dielectric support (not shown) can be used to securely support the PIFA 1204 in relation to the third circuit board 1200. Communication circuits (not shown) built on the third circuit board 1200 are used to drive the dipole antenna 1202, and the PIFA 1204.

The PIFA 1204 and the dipole antenna 1202 are centered on a longitudinal centerline 1216 of the third circuit board 1200. The signal feed 1302 and the grounding conductor 1402 are also centered on the longitudinal centerline 1216. Because of the symmetrical placement of the PIFA 1204, the signal feed 1302 and the ground conductor 1402 currents induced in the ground plane 1210 when the PIFA 1204 is used to receive or transmit signals are symmetric about the longitudinal centerline 1216. In contrast, currents induced in the ground plane 1210 when the dipole antenna 1202 is used to transmit or receive signals are antisymmetric.

Although not wishing to be bound by any particular theory of operation, it is believed 10. that the symmetry in the former case, and the antisymmetry in the latter case account for the low magnitude of coupling between the dipole antenna 1202 and the PIFA 1204 that is attained.

FIG. 15 is a third graph 1500 that includes plots of S parameters that characterize the third circuit board 1200 with the two antennas 1202, 1204 shown in FIGS. 12–14. The abscissa of the third graph 1500 indicates frequency and is marked off in gigahertz and the ordinate indicates the magnitude of various S-parameters and is marked off in decibels. A first plot 1502 is the return loss of the dipole antenna 1202 and a second plot 1504 is the return loss of the PIFA 1204. The dipole antenna 1202 and the PIFA 1204 have pass bands centered at about 1.75 Ghz. A third plot 1506 on the third graph 1500 is the magnitude of the coupling between the dipole antenna 1202 and the PIFA 1204. As reflected in the third graph 1500 coupling between the dipole antenna 1202 and the PIFA 1204 is limited to about −45 dB in the pass bands.

Figure 16:
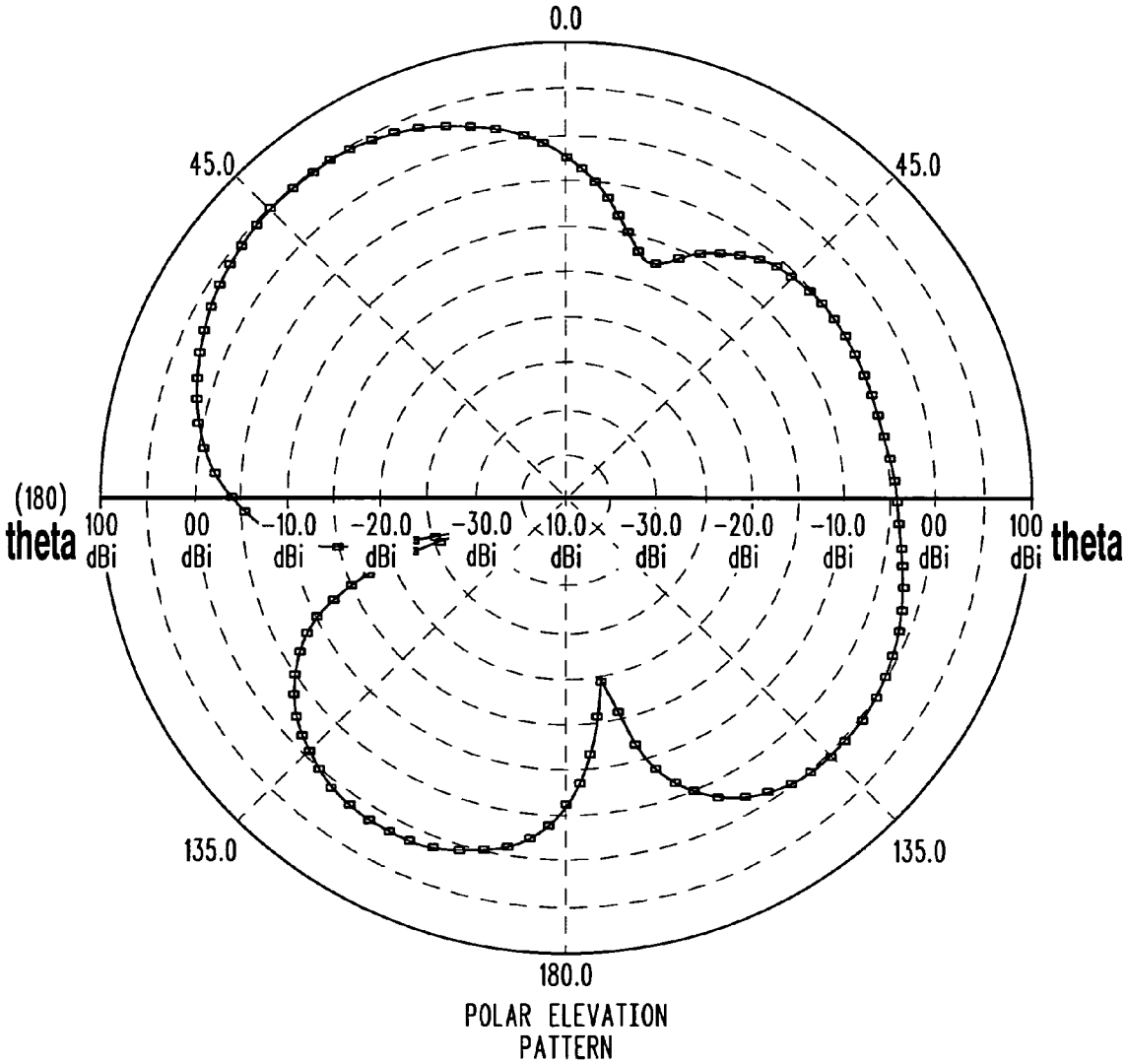
FIG. 16 is a polar gain plot of a first of the two antennas shown in FIGS. 12–14.
Figure 17:
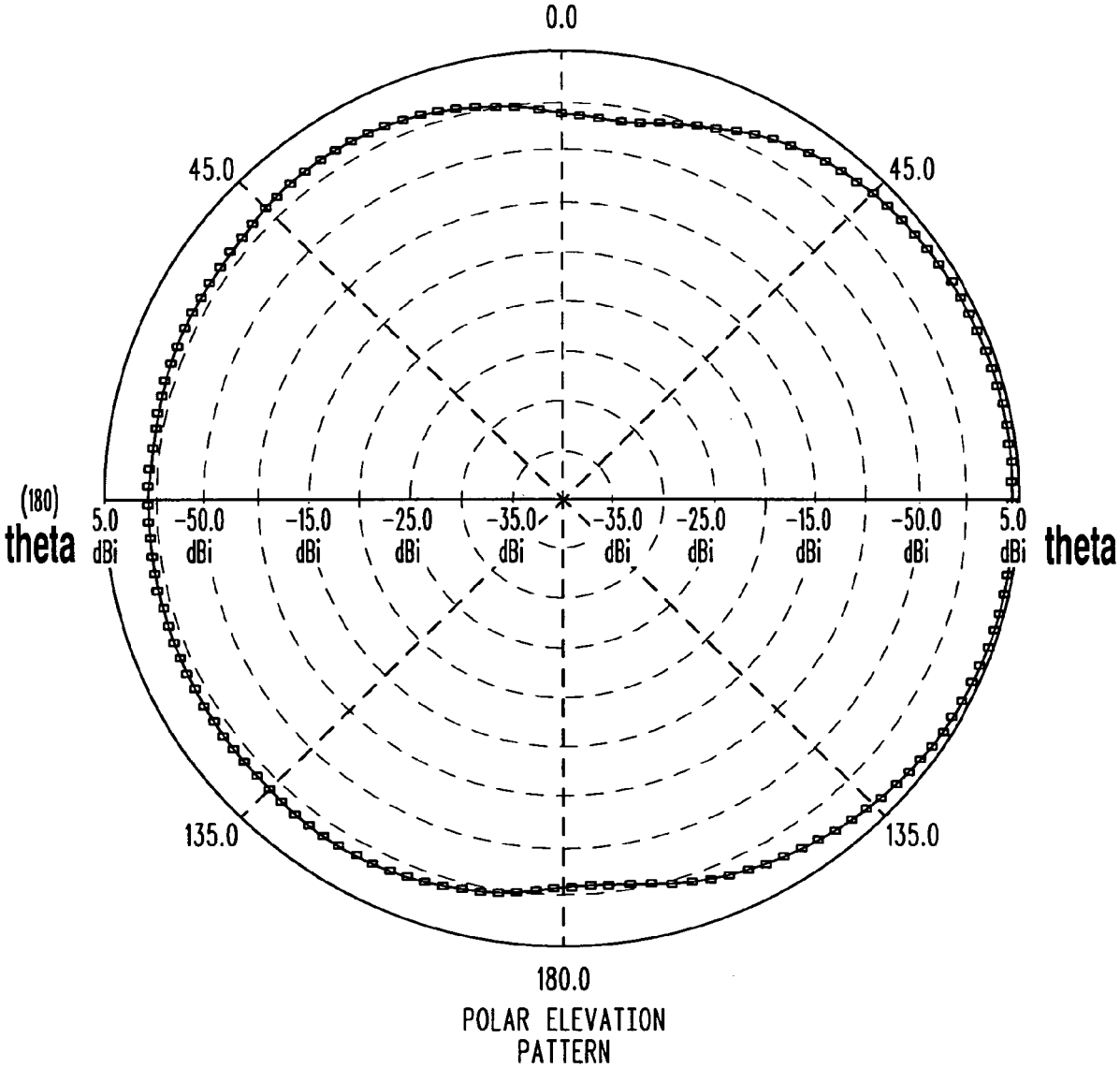
FIG. 17 is a polar gain plot of a second of the two antennas shown in FIGS. 12–14.

FIG. 16 is polar gain plot of the PIFA 1204, and FIG. 17 is a polar gain plot of the dipole antenna 1202. The gain plots shown in FIGS. 16, 17 are measured in a plane that includes the longitudinal centerline 1216 of the third circuit board 1200, and a vector perpendicular to the bottom surface 1214 of the third circuit board 1200. The independent variable in the gain plots shown in FIG. 16, 17 is a polar angle measured from the perpendicular to the bottom surface 1214 of the third circuit board 1200. The radial coordinate in the gain plots shown in FIGS. 16–17 is marked off in decibels.

The gain plot of the PIFA 1204 shown in FIG. 16 is for a radiated field component that is characterized by an electric field polarization in the plane in which the gain plots are measured. In the case of the PIFA 1204 the radiated field component characterized by an electric field polarization perpendicular to the plane of measurement is zero. In contrast the gain plot of the dipole antenna 1202 shown in FIG. 17 is for a radiated field component that is characterized by the electric field polarization perpendicular to the aforementioned plane of measurement, and the radiated field component characterized by the electric field polarization in the aforementioned plane of measurement is zero. Thus, in the antenna system embodied in the third circuit board 1200 with the two antennas 1202, 1204, the two antennas 1202, 1204 exhibit radiation patterns with different spatial distributions of the two polarization components. This is beneficial for MIMO systems, because it leads to decorrelation between signals emitted by, or received by the two antennas 1202, 1204, particularly in a highly scattering environment.

The differences in the spatial distribution of the two polarization components, in combination with the high level of isolation between the two antennas 1202, 1204 (which is exhibited in plot 1506 (FIG. 15) and is realized despite the fact that both antennas 1202, 1204 interact with the same limited size ground plane 1210) allows the decorrelation of signals resulting from the differing spatial distribution of the two polarization components for the two antennas 1202, 1204 to be preserved thereby allowing a MIMO device to be realized in the form of a compact handheld wireless communication device, e.g. 100. Moreover, in the case of the fourth embodiment, a MIMO device that does not require an external antenna is realized. Handheld devices with internal antennas are generally more compact, and their antennas are less prone to breakage.

Thus the antenna system embodied in the third circuit board 1200 with the dipole antenna 1202 and the PIFA 1204 is well adopted for use in a transceiver architecture with separate receive and transmit pathways such as shown in FIG. 6 or for use in a MIMO transceiver such as shown in FIG. 7.

Figure 18:
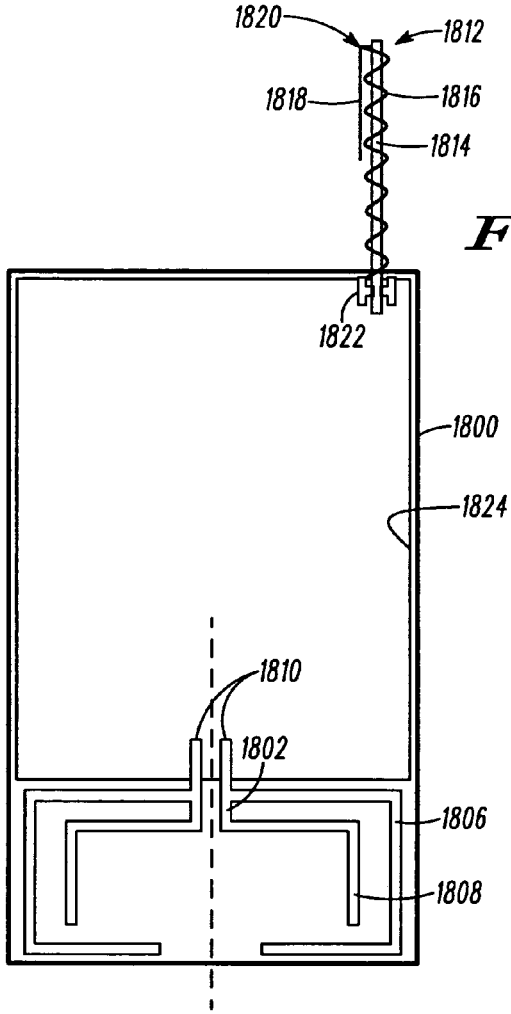
FIG. 18 is bottom view of a fourth circuit board with two dual frequency antennas according to a fifth embodiment.

FIG. 18 is a bottom view of a fourth circuit board 1800 with two dual frequency antennas 1802, 1812 according to a fifth embodiment. A first dual frequency antenna 1802 comprises a first folded dipole 1806 and a second folded dipole 1808 nested within the first folded dipole 1806 and connected in parallel with the first folded dipole 1806 to a pair of dipole feed terminals 1810. A second dual frequency antenna 1812 comprises a straight wire monopole antenna 1814 and a helical monopole antenna 1816 arranged coaxially about the straight wire monopole antenna 1814. A tuning extension 1818 extends downward from a top end 1820 of the helical monopole antenna 1816. Alternatively the pitch and or length of the helical monopole antenna 1816 is adjusted to achieve a desired pass band frequency. The straight wire monopole antenna 1814 and the helical monopole antenna 1816 are connected in parallel to a monopole feed terminal 1822. The fourth circuit board 1800 comprises a ground plane 1824. The monopole feed terminal 1822 and the dipole feed terminals 1810 are located proximate the periphery of the ground plane 1824.

Figure 19:
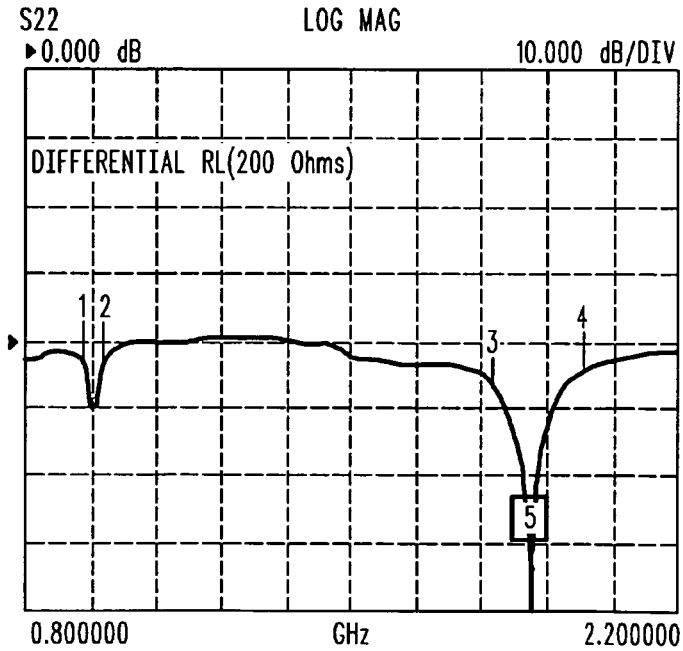
FIG. 19 is a plot of return loss for a first of the two dual frequency antennas shown in FIG. 18.

FIG. 19 is a plot 1902 of return loss for the first dual frequency antenna 1802 shown in FIG. 18. In FIG. 19 and FIG. 20 the abscissa indicates frequency and is marked of in gigahertz and the ordinate indicates relative magnitude of return loss. As shown in FIG. 19, the first dual frequency antenna 1802 exhibits a first pass band centered at about 0.94 GHz and a second pass band centered at about 1.85 Ghz.

FIG. 20 is a plot 2002 of return loss for the second dual frequency antenna 1812 shown in FIG. 18. As shown in FIG. 20, the second dual frequency antenna 1812 exhibits a first pass band overlapping the first pass band of the first dual frequency antenna 1802 and a second broad pass band overlapping the second pass band of the first dual frequency antenna 1802.

FIG. 21 is a plot of the magnitude of coupling between the two dual frequency antennas 1802, 1804 shown in FIG. 18. As shown in FIG. 21 the coupling between the two antennas 1802, 1804 is limited to about −24 dB in the first bands and limited to about −16 dB in the second bands. Thus, the fourth circuit board 1800 with the first dual frequency antenna 1802 and the second dual frequency antenna 1804 is suitable for use in a transceiver having separate receive and transmit pathways such as shown in FIG. 6 and in a MIMO transceiver such as shown in FIG. 7. Moreover, the fourth circuit board with two antennas 1802, 1804 is sufficiently compact for use in a handheld wireless communication device e.g., 100.

In the above described embodiments two antennas that interact with a ground plane of a circuit board are provided. Alternatively, the ground structure or counterpoise can take a different form. For example, a conductive housing part can serve as the ground structure or counterpoise with which two antennas interact.

While the preferred and other embodiments of the invention have been illustrated and described, it will be clear that the invention is not so limited. Numerous modifications, changes, variations, substitutions, and equivalents will occur to those of ordinary skill in the art without departing from the spirit and scope of the present invention as defined by the following claims.

The invention claimed is:

1. A handheld wireless communication device comprising:

an unbalanced feed antenna;

a finite ground structure disposed proximate said unbalanced feed antenna, said ground structure serving as a counterpoise for said unbalanced feed antenna; and a balanced feed antenna disposed proximate said ground structure wherein said balanced feed antenna is coupled through electromagnetic interaction to said ground structure;

wherein the unbalanced feed antenna connects to the finite ground structure near a first edge of the finite ground structure, and the balanced feed antenna connects to the finite ground structure near an edge opposite the first edge of the finite ground structure.

2. The handheld wireless communication device according to claim 1 wherein said unbalanced feed antenna comprises a first terminal disposed proximate a transverse center of said ground structure; and said balanced feed antenna comprises a second feed terminal and a third feed terminal that are disposed proximate said transverse center of said ground structure.

3. The handheld wireless communication device according to claim 1 wherein said unbalanced feed antenna comprises a first feed terminal disposed proximate a transverse center of said ground structure; and said balanced feed antenna comprises a second feed terminal and a third feed terminal which are disposed on opposite sides of said transverse center of said ground structure.

4. The handheld wireless communication device according to claim 1 wherein said ground structure comprises a ground plane of a printed circuit.

5. The handheld wireless communication device according to claim 4 wherein said unbalanced feed antenna is attached to said printed circuit, and said balanced feed antenna is disposed on said printed circuit.

6. The handheld communication device according to claim 1 wherein:

said ground structure comprises a first end and a second end opposite said first end;

wherein, said unbalanced feed antenna is disposed proximate said first end, and said balanced feed antenna is disposed proximate said second end.

7. The handheld communication device according to claim 1 wherein:

said balanced feed antenna comprises a dipole antenna; and said unbalanced feed antenna comprises a monopole antenna.

8. The handheld communication device according to claim 1 wherein:

said balanced feed antenna comprises a dipole antenna; and unbalanced feed antenna comprises a planar inverted "F" antenna.

9. The handheld communication device according to claim 1 further comprising:

a transmitter coupled to said unbalanced feed antenna; and a receiver coupled to said balanced feed antenna.

10. The handheld communication device according to claim 1 further comprising:

a receiver coupled to said unbalanced feed antenna; and a transmitter coupled to said balanced feed antenna.

11. The handheld communication device according to claim 1 further comprising:

a first demodulator coupled to said unbalanced feed antenna;

a second demodulator coupled to said balanced feed antenna;

a MIMO processor coupled to said first demodulator and said second demodulator.

12. The handheld communication device according to claim 1 further comprising:

a first modulator coupled to said unbalanced feed antenna;

a second modulator coupled to said balanced feed antenna;

a MIMO processor coupled to said first modulator and said second modulator.

13. A handheld wireless communication device comprising:

a finite ground structure;

a fist antenna that establishes a first current pattern in said ground structure that exhibits substantial bilateral antisymmetry about a longitudinal axis of said ground structure;

a second antenna disposed proximate said ground structure, wherein said second antenna establishes a second current pattern that does not exhibit substantial bilateral antisymmetry about said longitudinal axis of said ground structure; and wherein the first antenna connects to the finite ground structure near a first edge of the finite ground structure, and the second antenna connects to the finite ground structure near an edge opposite the first edge of the finite ground structure.

14. The handheld wireless communication device according to claim 13 wherein:

said second current pattern exhibits substantial bilateral symmetry about said longitudinal axis of said ground structure.

15. The handheld wireless communication device according to claim 13 wherein:

said second antenna is centered on said longitudinal axis.

16. The handheld communication device according to claim 13 wherein:

said second antenna comprises an unbalanced feed antenna.

17. The handheld communication device according to claim 13 wherein:

said second antenna comprises a monopole antenna.

18. The handheld communication device according to claim 13 wherein:

said second antenna comprises a planar inverted "F" antenna.

19. A handheld wireless communication device comprising:

a circuit board comprising a first end, a second end, a longitudinal axis that extends between said first end and said second end, and a finite ground structure;

a dipole antenna supported on said circuit board, wherein said dipole antenna is arranged perpendicular to said longitudinal axis, and said dipole antennas is disposed in substantially non overlapping relation to said ground structure; and an unbalanced feed antenna disposed proximate said circuit board, whereby said ground structure of said circuit board serves as a counterpoise to said unbalanced feed antenna;

wherein the dipole antenna connects to the finite ground structure near a first edge of the finite ground structure, and the monopole antenna connects to the finite ground structure near an edge opposite the first edge of the finite ground structure.

20. The handheld wireless communication device according to claim 19 wherein:

said unbalanced feed antenna comprises a monopole antenna.

21. The handheld wireless communication device according to claim 19 wherein said unbalanced feed antenna comprises a planar inverted "F" antenna.

22. The handheld wireless communication device according to claim 19 wherein:

said dipole antenna is disposed proximate said first end of said circuit board; and said unbalanced feed antenna is disposed proximate said second end of said circuit board, and proximate a transverse center of said circuit board.

* * * * *